US006710642B1

(12) United States Patent
Tang et al.

(10) Patent No.: US 6,710,642 B1
(45) Date of Patent: Mar. 23, 2004

(54) BIAS GENERATION CIRCUIT

(75) Inventors: Stephen H. Tang, Beaverton, OR (US); Siva G. Narendra, Portland, OR (US); Vivek K. De, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/334,644

(22) Filed: Dec. 30, 2002

(51) Int. Cl.[7] ..... G05F 1/10
(52) U.S. Cl. ..... 327/539
(58) Field of Search ..... 327/530, 534, 327/535, 537, 538, 539, 540, 541, 543

(56) References Cited

U.S. PATENT DOCUMENTS 5,495,166 A * 2/1996 Alini et al. ..... 323/314
5,867,013 A * 2/1999 Yu ..... 323/314
6,052,020 A * 4/2000 Doyle ..... 327/539
6,281,743 B1 * 8/2001 Doyle ..... 327/539
6,400,212 B1 * 6/2002 Sakurai ..... 327/539
6,407,611 B1 * 6/2002 Larsen et al. ..... 327/362
6,563,371 B2 * 5/2003 Buckley et al. ..... 327/539

OTHER PUBLICATIONS

P. Gray and R. Meyer; "Chapter 4: Transistor Current Sources and Active Loads"; Analysis and Design of Analog Integrated Circuits; John Wiley & Sons, New York; 1993 (pp. 338–347).

Filanovsky, I.M. et al.; "Temperature Dependence of Output Voltage Generated by Interaction of Threshold Voltage and Mobility of an NMOS Transistor"; Analog Integrated Circuits and Signal Processing, 27; ©2001 Kluwer Academic Publishers. (pp. 229–238).

* cited by examiner

*Primary Examiner*—Jeffrey Zweizig
(74) *Attorney, Agent, or Firm*—Buckley, Maschoff & Talwalkar LLC

(57) ABSTRACT

According to some embodiments, a bias generation circuit is provided.

19 Claims, 5 Drawing Sheets

BIAS GENERATION CIRCUIT

BACKGROUND

A circuit may be used to bias other components or circuits. For example, a circuit may generate a bias current and provide it to a component to establish the proper mode of operation of the component. As a particular example, a bandgap circuit may be used to provide a bias current to analog components, such as an amplifier. A constant and precise bias current allows these components to perform at their intended range of operation.

Existing bandgap circuits may be formed from diodes and take advantage of the Arrhenius dependence of current in a diode to generate currents and voltages that are proportional to the absolute temperature. Generally, existing bandgap circuits are used to generate a temperature-independent voltage which is then passed to an external precision resistor to convert this voltage into a temperature-independent current for use by components such as amplifiers. Due to packaging and other design constraints, it may be undesirable to dedicate two pins of a package to the generation of such a temperature-independent current.

Current in a diode is proportional to its area. Generally, existing bandgap circuits utilize diodes that are biased well above their turn-on voltages of approximately 0.7 Volts (V). Advances in process and fabrication technologies have led to the introduction of circuits and components having lower supply voltages. At lower supply voltages, many bandgap circuits which utilize diodes are not practical because it is difficult to generate the required voltage drop. Existing bandgap circuits are not suited for use in systems which have supply voltages in the range of 1V and lower, unless large amounts of valuable substrate area are allocated to the fabrication of the diodes.

DETAILED DESCRIPTION

Some embodiments are associated with circuits that generate a bias current for application to one or more components or circuits which is substantially insensitive to variations in temperature. Some embodiments are associated with circuits that operate in devices or systems having supply voltages of approximately 1V or less (although embodiments may be implemented in circuits having higher supply voltages as well as embodiments which are substantially supply-voltage independent).

Figure 1:
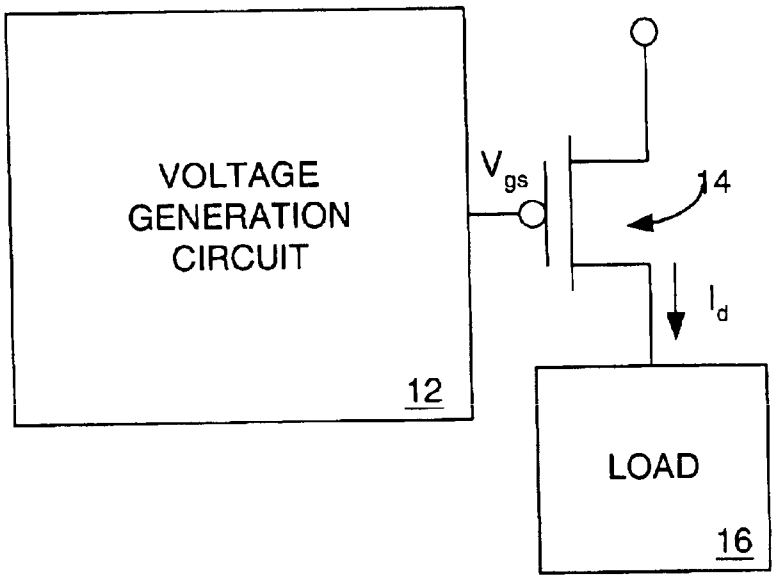
FIG. 1 is a block diagram of a circuit according to some embodiments.

Details of features of embodiments will be described by first referring to FIG. 1, where a voltage generation circuit 12 is shown connected to a gate of a Metal-Oxide-Semiconductor-Field-Effect-Transistor ("MOSFET" or "MOS transistor") 14 to generate a reference current ($I_d$) for application to a load 16. In the embodiment depicted, MOS transistor 14 is a p-channel MOSFET. Embodiments allow the generation of an $I_d$ which is substantially insensitive to variations in temperature. This temperature insensitivity is achieved, in part, by applying a voltage to a gate of MOS transistor 14 which is only linearly dependent on temperature. Embodiments generate a temperature-insensitive current from a MOSFET by identifying a zero temperature coefficient ("ZTC") gate voltage ($V_{ZTC}$) at which the drain current ($I_d$) of the MOSFET is substantially independent of temperature variations. Further, the drain current may be provided to load 16 on-chip (e.g., without need for routing the bias current to an off-chip precision resistor prior to delivery to the load). The current generated when the zero temperature coefficient gate voltage ($V_{ZTC}$) is applied to the gate of MOS transistor 14 is referred to as the zero temperature coefficient drain current ($I_{ZTC}$).

The voltage applied to the gate of MOS transistor 12 is of the form:

$$V_{gs}=V_{ZTC}+\beta T(1-I_d/I_{ZTC}), \quad (1)$$

where $\beta$ is the slope of $V_T$ (the threshold voltage of MOS transistor 12) versus temperature and $I_d$ is the resulting temperature-independent current. In general, this relationship holds only if both $V_T$ follows the form $V_{to}+\beta T$ and if mobility is proportional to $(1/T)^2$ (where $V_{to}$ is the threshold voltage extrapolated to absolute zero temperature). Applicants performed simulations to show the relationship between various applied gate voltages, the resulting drain currents, and temperature for a simulated device. These simulation results are depicted in FIG. 2 (those skilled in the art will appreciate that these results are for one sample simulated device, and that the actual values will depend on process and other design considerations).

Figure 2:
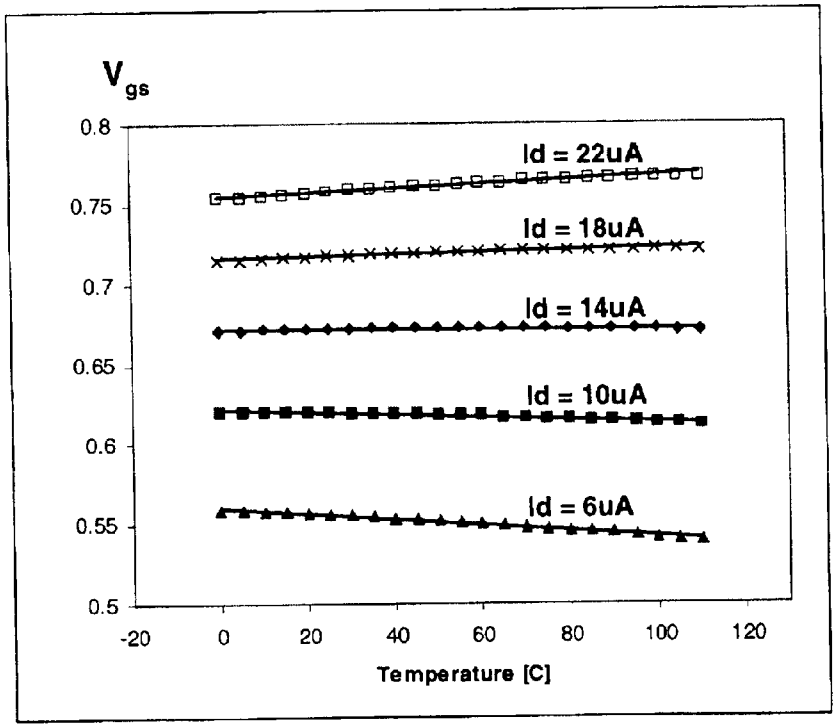
FIG. 2 is illustrates the relationship between a gate voltage, temperature, and current in a circuit such as the circuit of FIG. 1.

As shown in FIG. 2, there is a zero temperature coefficient voltage ($V_{ZTC}$) which results in the generation of a zero temperature coefficient current, where the current remains substantially stable despite wide variations in temperature. In the simulation results depicted in FIG. 2, various $V_{gs}$ values for various fixed currents forced into a diode-connected MOS transistor are shown. $V_{gs}$, as shown, is linearly dependent on changes in temperature for the various fixed currents. In the simulation results depicted in FIG. 2, the zero temperature voltage is approximately 0.67 V, resulting in a zero temperature current of approximately 14 $\mu$A. At the zero temperature point of operation, MOS transistor 14 has its carrier mobility and $V_T$ balanced and the device operates substantially without dependence on temperature.

Figure 3:
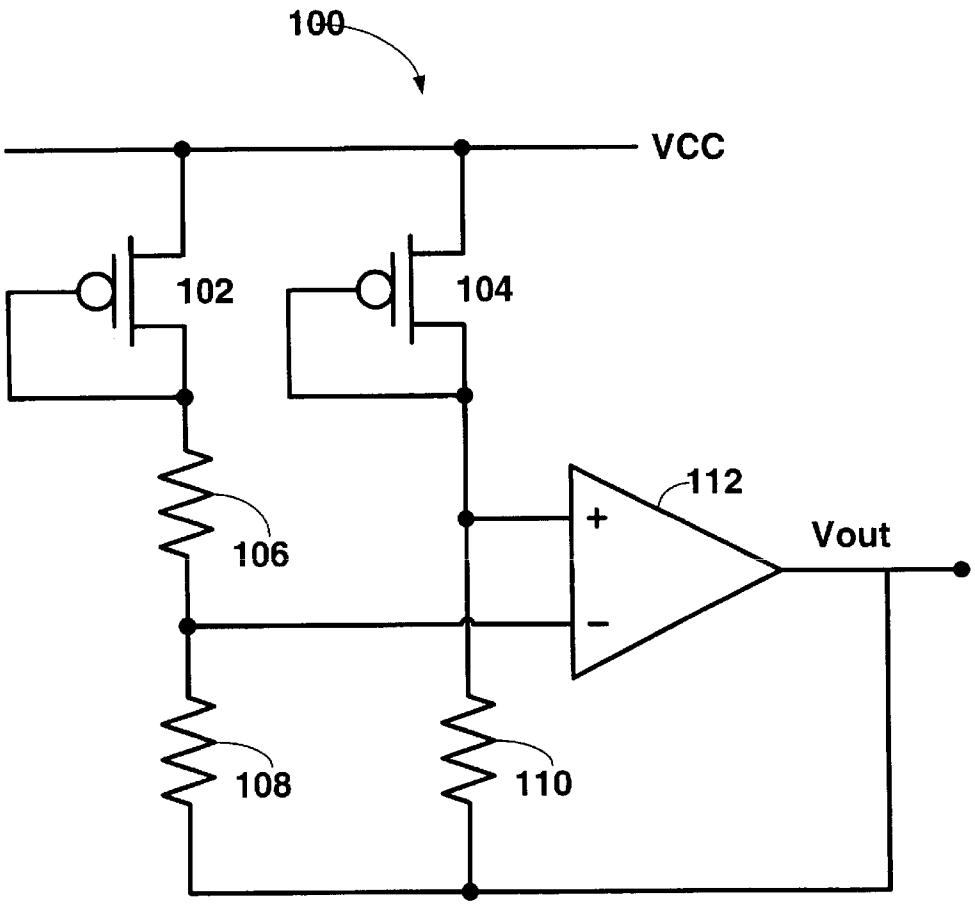
FIG. 3 is a block diagram of a bandgap circuit according to some embodiments.

Applicants have developed circuits which generate a $V_{gs}$ for application to MOS transistor 14 which is substantially only linearly dependent on variations in temperature, which allows tuning of device operation using one or more adjustable resistors, and which may be used to generate a stable and temperature insensitive output current in systems having low supply voltages (e.g., including systems operating using supply voltages of approximately 1 V or even less). Reference is now made to FIG. 3, where a bandgap circuit 100 is shown which may be used to generate an output voltage ($V_{out}$) which is substantially only linearly dependent on variations in temperature.

Bandgap circuit 100 includes MOS transistors 102, 104 (depicted as p-channel MOS transistors) which are configured to operate as diode-connected transistors (i.e., having their gate and drains shorted together). Because transistors 102, 104 have their gates and drains shorted together, each remains biased in the saturation region so long as its gate-source voltage ($V_{gs}$) is less negative (or equal to) than its drain-source voltage ($V_{ds}$). While circuit 100 is shown implemented using p-channel MOSFETs, upon reading this disclosure, those skilled in the art will recognize that similar results may be attained by configuring circuit 100 (and circuit 200 discussed further below) using n-channel MOSFETs.

Transistors 102 and 104 each have a source connected to a voltage source (shown as a supply voltage $V_{cc}$). The drain of transistor 102 is coupled in series with resistors 106 and 108 (having resistances R3 and R2, respectively), while the drain of transistor 104 is coupled in series with resistor 110 (having a resistance R1). Transistors 102 and 104 are biased for operation in the subthreshold region, and are generally matched to have substantially the same threshold voltage.

An amplifier 112 is coupled to operate as a differential amplifier producing an output voltage ($V_{out}$) having a known temperature dependence which is only linearly dependent on variations in temperature. In particular, as depicted, amplifier 112 is coupled in a feedback configuration where $V_{out}$ is coupled to inputs (+ and −) of amplifier 112 via resistors 108 and 110. In general, amplifier 112 is selected to have sufficiently high gain to force the (+) and (−) inputs to be approximately equal and to reduce the impact of process variations in the fabrication of circuit 100.

The two inputs received by amplifier 112 include a first input receiving a signal generated across resistor 110 and a second input receiving a signal generated across resistor 108. The values of resistors 106, 108 and 110 (whose resistances are referred to herein as resistances R3, R2, and R1, respectively) are selected to introduce an extra voltage drop between MOS transistors 102, 104. In some embodiments, resistor 108 is a variable resistor. By varying the resistance (R2) of resistor 108, as will be described further herein, various output characteristics of circuit 100 may be tuned. In other embodiments, the resistances of resistors 106 and/or 110 may additionally (or alternatively) be varied to achieve desired output characteristics. In general, resistors 106, 108, and 110 are sized based on characteristics of transistors 102, 104 to achieve voltage values at the (+) and (−) inputs of amplifier 112 which are substantially equal given a relatively high gain in amplifier 112.

In operation, bandgap circuit 100 generates an output voltage $V_{out}$ having the form:

$$V_{out}=V_{to}+\alpha T. \tag{2}$$

As shown in (2), and in the circuit of FIG. 3, $V_{out}$ is relatively resistant to variations in temperature because both $V_{to}$ and $\alpha$ are generally not dependent on temperature. In the circuit of FIG. 3, $V_{to}$ is generally equal to the threshold voltage of transistors 102, 104 extrapolated to absolute zero temperature. In the circuit of FIG. 3, $\alpha$ predominantly depends on the ratio of resistors R2/R1 and R2/R3. Accordingly, because $V_{to}$ and $\alpha$ are generally not dependent on temperature, $V_{out}$ is generated with a linear dependence on temperature. Further, in embodiments where one or more of resistors 106, 108, and 110 are variable, the output voltage ($V_{out}$) may be varied by varying the resistance. For example, the value of resistor 108 (resistance R2) may be varied to adjust or tune the output voltage as desired.

In some embodiments, the voltage output from circuit 100 may be passed directly to a MOS transistor (such as transistor 12 of FIG. 1) in order to provide a current to a load. That is, circuit 100 may be utilized in applications in which traditional diode-based bandgap circuits are used. Circuit 100 is suitable for use in environments having low supply voltages (e.g., including applications having supply voltages of approximately 1V or even lower).

Figure 4:
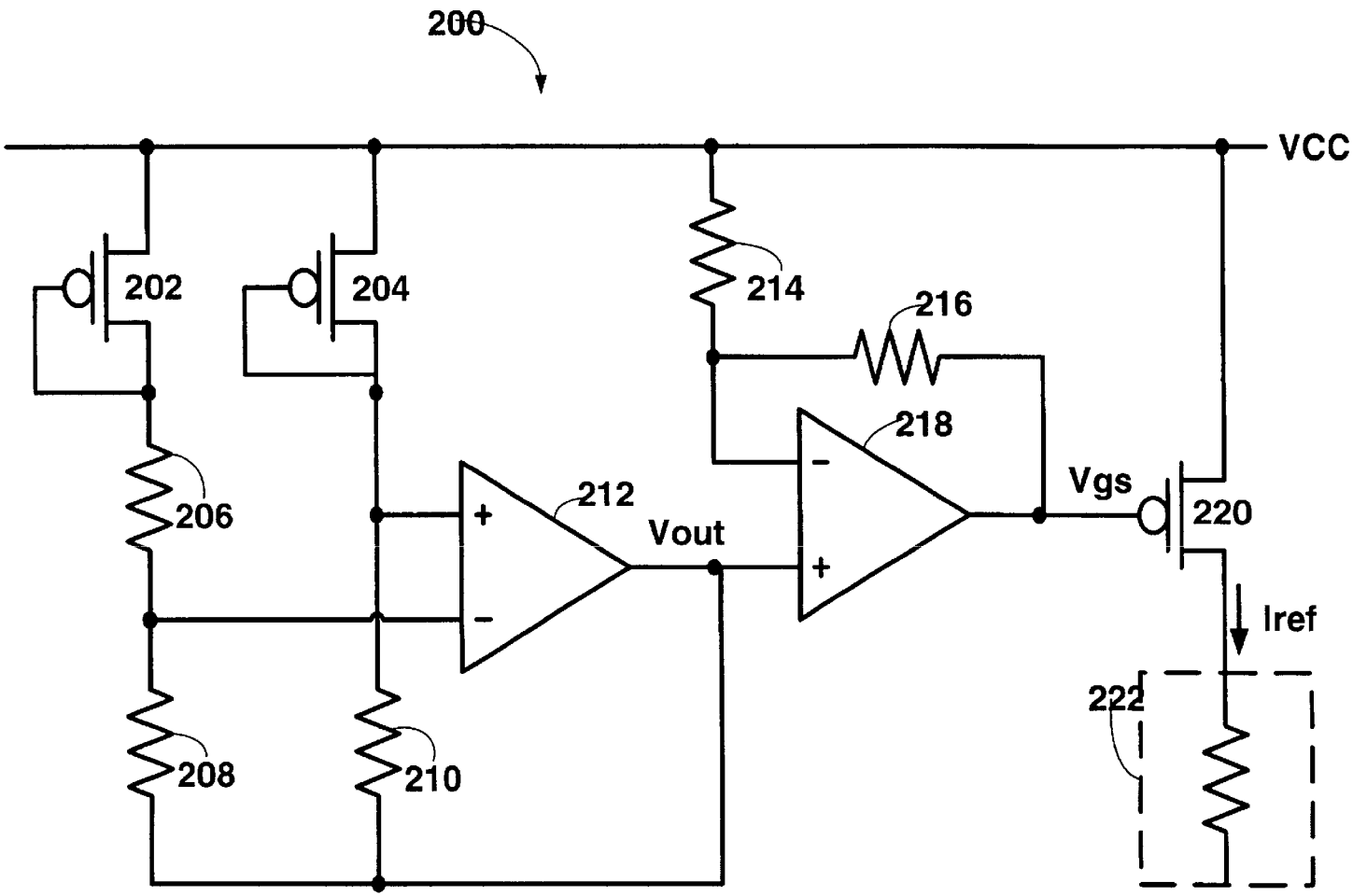
FIG. 4 is a block diagram of a further circuit according to some embodiments.

Embodiments allow the generation of a temperature-insensitive current by combining bandgap circuit with an amplifier stage as will now be described by reference to FIG. 4. As shown in FIG. 4, a current generation circuit 200 is shown which utilizes bandgap circuit 100 to generate an output current ($I_{ref}$) which is relatively temperature and supply voltage independent and which may be provided to a load device on-chip (e.g., without need to be routed to an external precision resistor prior to delivery to a load device).

Current generation circuit 200 includes a bandgap circuit portion (configured as described above in conjunction with FIG. 3) including diode-configured, p-channel MOSFETs 202, 204 coupled to an amplifier 212 and resistors 206, 208 and 210 to provide an intermediate output voltage ($V_{out}$) which is only linearly dependent on variations in temperature. The intermediate output voltage generated by the bandgap circuit portion is passed to an input of an amplifier 218 which is configured as a differential amplifier receiving a second input coupled to a resistor 214 (having a resistance R4) coupled to a supply voltage ($V_{cc}$) and to a resistor 216 (having a resistance R5) coupled to an output of amplifier 218. The output of amplifier 218 is coupled to a gate of a p-channel MOSFET transistor 220. Transistor 220 has a source coupled to the supply voltage ($V_{cc}$) and a drain coupled to a load 222.

In operation, circuit 200 functions to scale the intermediate output ($V_{out}$) from the bandgap portion of the circuit by a factor (k) using amplifier 218. The resulting output voltage presented at the gate of transistor 220 ($V_{gs220}$) is represented as:

$$V_{gs220}=kV_{to}+\alpha kT. \tag{3}$$

Circuit 200 may be designed to generate a desired output voltage ($V_{gs220}$) using the relationships described above in conjunction with FIG. 1. For example, circuit 200 may be voltage matched by tuning the various resistor values to set $k=V_{ztc}/V_{to}$ and $\alpha=\beta/k*(1-I_d/I_{ztc})$. Put another way, the output voltage at the gate of transistor 220 has the relationship:

$$V_{gs220}=-k(V_{to}+\alpha T),\ \text{where } k=1+(R5/R4). \tag{4}$$

The threshold voltages of each of the transistors 202, 204 and 220 are matched to be substantially the same. The threshold voltage, as described above in conjunction with FIG. 3, is selected to provide a desired drain current value at the zero temperature point of operation. The temperature-independent current generated by circuit 200 is the drain current of transistor 220. Transistor 220 may be maintained in saturation mode by designing load 222 to keep $V_{ds220}$ greater than $V_{gs220}-V_T$.

Circuit 200 may be tuned to provide a desired temperature-independent current to load 222 by tuning one of two variables of equation (4): the variable k or the variable $\alpha$. In some embodiments, k is generally fixed as a design choice (e.g., by the selection of the ratio of resistances R5/R4 as described in eq. (4) above), and the variable $\alpha$ is tuned by varying the resistance of one of the resistors of circuit 200. For example, as described above in conjunction with the circuit of FIG. 3, one or more of the resistors in the bandgap circuit portion may be implemented as variable resistors, allowing the tuning of the variable $\alpha$. In some embodiments, resistor 208 is implemented as a variable resistor and its resistance may be varied to change the variable $\alpha$. By varying $\alpha$, the voltage applied to the gate of MOS transistor 220 may be varied to achieve a zero temperature voltage which results in the generation of a zero temperature current. In some embodiments, other voltages which are linearly dependent on temperature may be selected to provide temperature-insensitive currents (e.g., as described and shown in conjunction with the graph of FIG. 2, there may be a number of linearly-dependent gate voltages which may result in temperature-insensitive currents and providing desired characteristics). Other resistances in circuit 200 may also be varied to achieve desired tuning of $\alpha$.

As described above in conjunction with FIG. 1 (and as illustrated in the example simulation results depicted in FIG. 2), when a zero temperature coefficient voltage ($V_{ZTC}$) is applied to a gate of MOS transistor 220, a zero temperature coefficient current ($I_{ZTC}$) is generated. This temperature-independent current may be delivered on-chip to a load such as load 222 without need for off-chip precision resistors or the like. Load 222 may be any of a number of different types of loads, such as, for example, circuits using a differential pair configuration as a gain stage (e.g., such as an amplifier), a current mirror (e.g., to distribute the current to other circuits), or the like. Other loads may also beneficially utilize the temperature-independent current generated using circuit 200. Because no off-chip precision resistors are needed, designs using circuit 200 may be manufactured with fewer pins.

Figure 5:
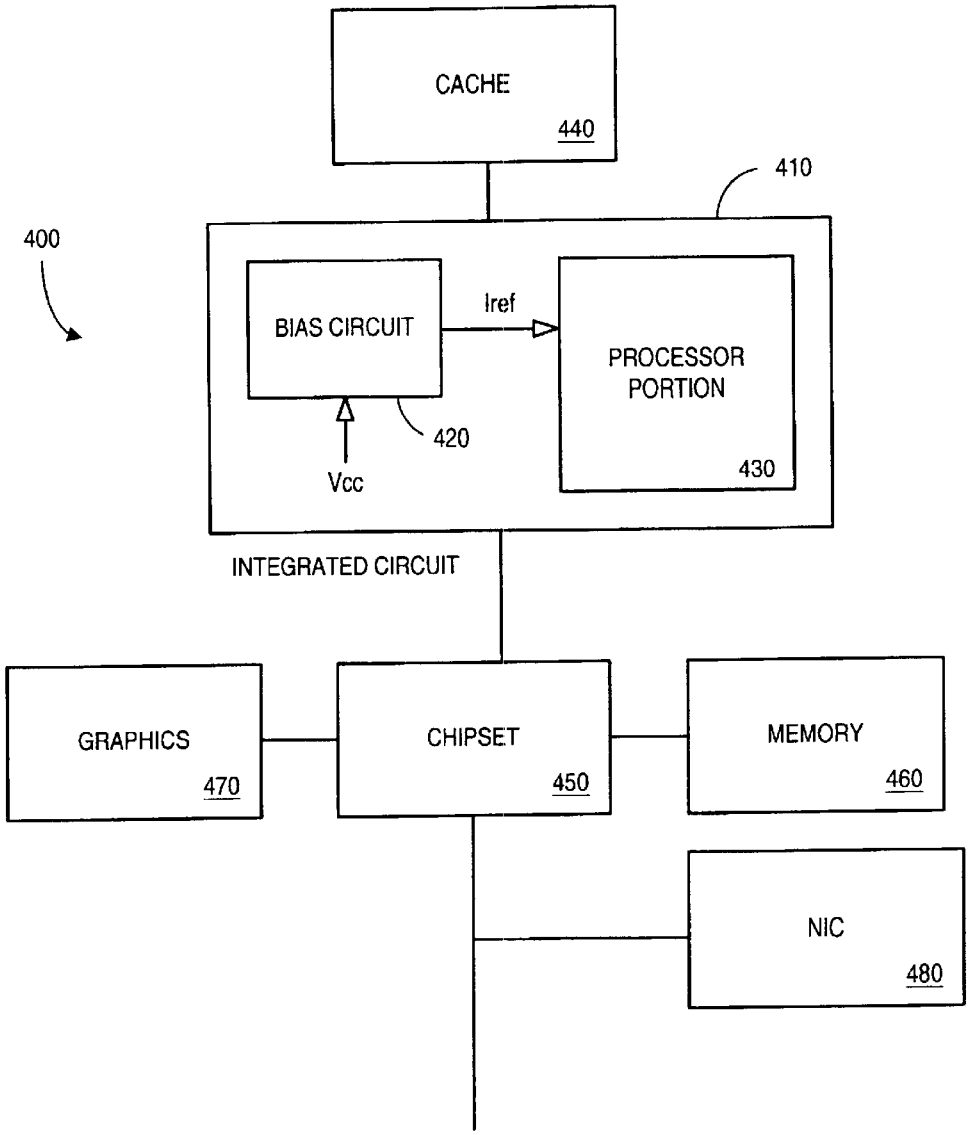
FIG. 5 is a block diagram of a system utilizing features of some embodiments.

FIG. 5 is a block diagram of a system 400 including an integrated circuit 410 according to some embodiments. The integrated circuit 410 includes a bandgap circuit 420 that receives $V_{cc}$ and provides output signals (e.g., including an output current $I_{ref}$) to a load (such as a component or circuit in processor portion 430). The load may be any of a number of different types of circuits or components (e.g., such as, for example, analog devices or other circuits requiring a stable current source). Bandgap circuit 420 may utilize any of the embodiments described herein (e.g., bandgap circuit 420 may be configured to provide a temperature-resistant current as described above). According to some embodiments, bandgap circuit 420 is instead located outside of integrated circuit 410. Moreover, integrated circuit 410 may be a processor or any other type of integrated circuit. According to some embodiments, integrated circuit 410 also communicates with an off-die cache 440. Integrated circuit 410 may also communicate with a system memory 460 via a host bus and a chipset 450. In addition, other off-die functional units, such as a graphics accelerator 470 and a Network Interface Controller (NIC) 480 may communicate with integrated circuit 410 via appropriate busses.

The several embodiments described herein are solely for the purpose of illustration. Persons skilled in the art will recognize from this description other embodiments may be practiced with modifications and alterations limited only by the claims.

What is claimed is:

1. A circuit, comprising:

a first MOS transistor having a source coupled to a voltage source, and a drain shorted to a gate and coupled to a first resistor;

a second MOS transistor having a source coupled to said voltage source, and a drain shorted to a gate and coupled to a second resistor; and an amplifier having a first input coupled to said drain of said first MOS transistor and a second input coupled to said second MOS transistor through said second resistor, said amplifier generating an output voltage which is linearly dependent on temperature variations.

2. The circuit of claim 1, wherein said supply voltage is less than approximately 1 V.

3. The circuit of claim 1, wherein said output voltage is coupled to said drains of said first and second MOS transistors through said first and second resistors.

4. The circuit of claim 1, wherein said second resistor is coupled in series to a third resistor, one of which is a variable resistor.

5. The circuit of claim 4, further comprising:

a second amplifier having a first input coupled to receive said output voltage and a second input coupled to said supply voltage through a fourth resistor and coupled to an output of said second amplifier through a fifth resistor; and a third MOS transistor having a gate coupled to said output of said second amplifier and a drain coupled to provide a substantially temperature-independent current to a load.

6. The circuit of claim 5, wherein at least one of said first, second and third MOS transistors are p-channel MOS transistors.

7. The circuit of claim 5, wherein at least one of said first, second and third MOS transistors are n-channel MOS transistors.

8. A circuit, comprising:

a bandgap circuit portion formed from a first and a second diode-connected MOS transistor each having a source coupled to a voltage source and a drain coupled to an input of a first feedback-connected differential amplifier to produce an intermediate output voltage which is linearly dependent on variations in temperature; and an amplifier portion formed from a second feedback-connected differential amplifier receiving said intermediate output voltage and a third MOS transistor having a gate coupled to an output of said second amplifier to produce a drain current which is substantially insensitive to said variations in temperature.

9. The circuit of claim 8, wherein said first, second and third MOS transistors each have substantially the same threshold voltage.

10. The circuit of claim 8, further comprising a first and a second resistor coupled between an output of said first amplifier and said drain of said first MOS transistor, at least one of said resistors formed as a variable resistor.

11. The circuit of claim 8, further comprising a third resistor coupled between said output of said first amplifier and said drain of said second MOS transistor.

12. The circuit of claim 8, wherein said circuit has a zero temperature mode of operation where the drain current produced by said third MOS transistor is substantially insensitive to variations in temperature.

13. The circuit of claim 12, wherein said circuit is placed in said zero temperature mode of operation by varying a value of a resistor in said bandgap portion of said circuit.

14. A device, comprising:

a first circuit portion having a first and a second diode-connected MOS transistor, each having a source coupled to a voltage source and a drain coupled to an input of a first feedback-connected differential amplifier to produce an intermediate output voltage which linearly depends on variations in an operating temperature;

a second circuit portion having a second feedback-connected differential amplifier receiving said intermediate output signal and a third MOS transistor having a gate coupled to an output of said second amplifier to produce a temperature independent drain current; and a load, coupled to receive said temperature independent output current.

15. The device of claim 14, wherein said load is an analog component.

16. The device of claim 14, wherein said load is matched to maintain said third MOS transistor in saturation.

17. The device of claim 14, wherein said second feedback-connected differential amplifier is selected to scale said intermediate output voltage by a desired amount.

18. A system, comprising:

a chipset; and a die comprising a microprocessor in communication with the chipset, wherein the microprocessor includes a bias circuit comprising:

a first circuit portion having a first and a second diode-connected MOS transistor, each having a source coupled to a voltage source and a drain coupled to an input of a first feedback-connected differential amplifier to produce an intermediate output voltage which linearly depends on variations in temperature; and a second circuit portion having a second feedback-connected differential amplifier receiving said intermediate output signal and a third MOS transistor having a gate coupled to an output of said second amplifier to produce an output current which is substantially independent of variations in temperature.

19. The system of claim 18, wherein said first, second and third MOS transistors each have substantially the same threshold voltage.

* * * * *